United States Patent [19]

Prohaska

[11] 4,054,308

[45] Oct. 18, 1977

[54] LOCK FOR SLIDING CLOSURES

[76] Inventor: Peter J. H. Prohaska, Rte. 5, Box 683-A, Ocala, Fla. 32670

[21] Appl. No.: 627,396

[22] Filed: Oct. 30, 1975

[51] Int. Cl.[2] ..... E05C 3/04

[52] U.S. Cl. ..... 292/204; 292/DIG. 46; 49/449

[58] Field of Search ..... 292/204, 238, 230, 231, 292/DIG. 46; 49/449

[56] References Cited

U.S. PATENT DOCUMENTS

| | | | |
|---|---|---|---|
| 355,080 | 12/1886 | Hinkle | 292/230 |
| 1,069,079 | 7/1913 | Voight | 292/DIG. 46 |
| 1,350,698 | 8/1920 | Boedtcher | 292/DIG. 46 |
| 1,388,272 | 8/1921 | Lawrence | 49/449 |
| 1,558,728 | 10/1925 | Wagner | 49/449 |
| 3,352,586 | 11/1967 | Hakanson | 292/DIG. 46 |

*Primary Examiner*—Robert A. Hafer

*Attorney, Agent, or Firm*—Beveridge, DeGrandi, Kline & Lunsford

[57] ABSTRACT

Sliding closures such as sliding glass doors or windows are locked by a stop member mounted in the upper track for the closures. The stop member is elongated longitudinally of the track and is pivoted about a transverse horizontal axis to permit its movement between an upper retracted position and a lower door-abutting position. The principal improvements comprise: (a) a stationary shoulder which abuts a part of the stop member when in its door-abutting position to resist excessive forces applied against the stop member by sliding movement of the door; (b) stationary pivotal supports for the stop member connected on both sides thereof to the track; and, (c) the supplemental use of a lateral projection attached to an outer sliding door for abutment by the stop member. Further, there is provided a novel spacer assembly in the upper track to limit upward movement of the door.

14 Claims, 4 Drawing Figures

FIG. 1
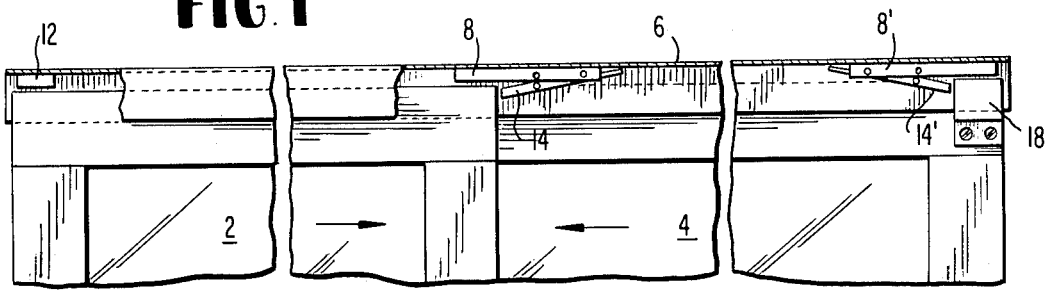
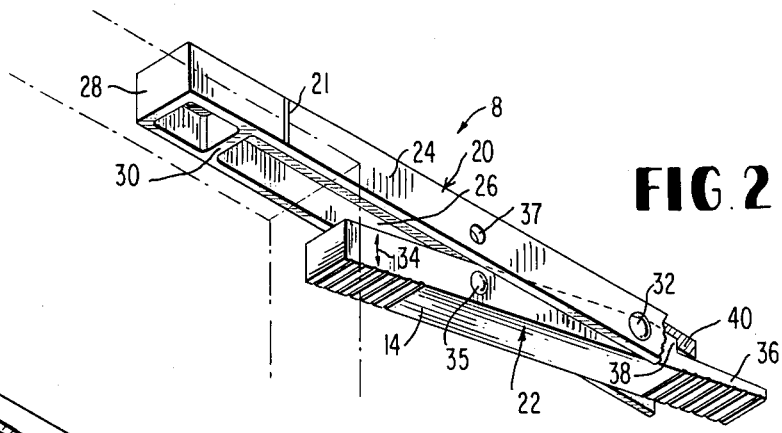
FIG. 2
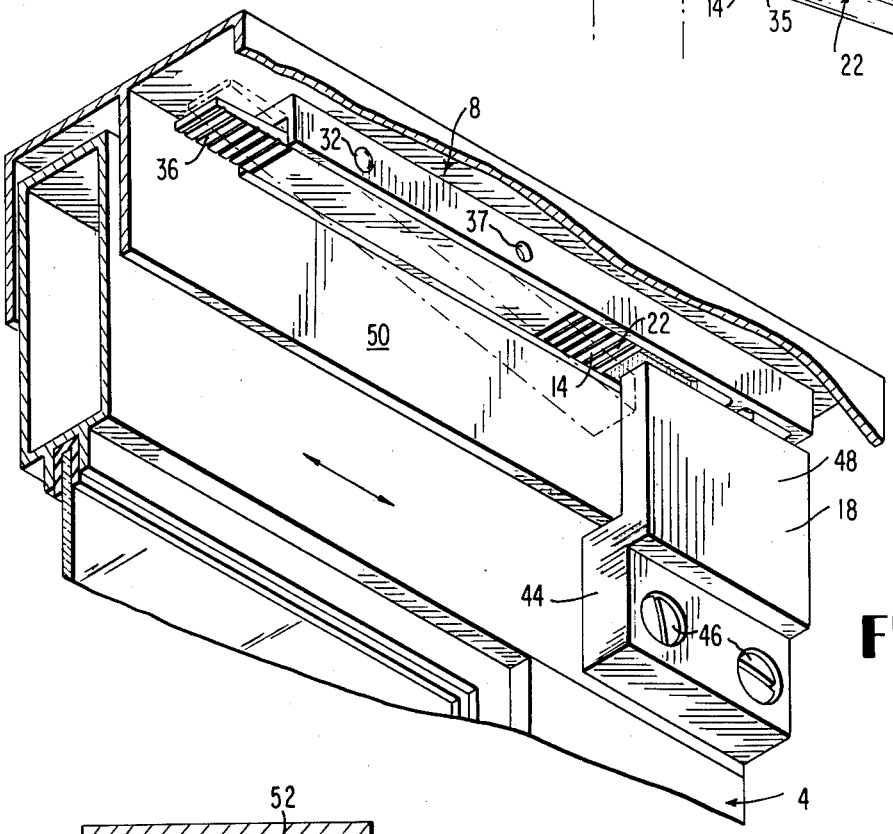
FIG. 3
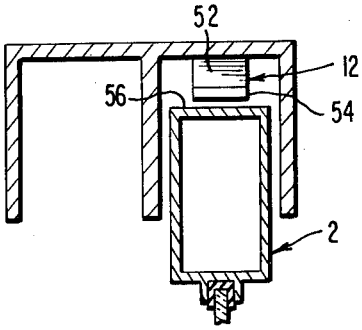
FIG. 4

LOCK FOR SLIDING CLOSURES

BACKGROUND AND SUMMARY OF THE INVENTION

This invention relates to improvements in a known type of latch assembly for sliding building closures such as sliding glass doors or windows. Heretofore, such devices mounted in the upper track for sliding doors have been provided with a stop member elongated in a direction parallel to the track and pivoted about a transverse horizontal axis so that a door-abutting portion of the stop member moves vertically between an upper retracted position and a lower door-abutting position in the path of the door. Vertical movement of the opposite or tail end of the stop member is limited in order to limit the downward movement of the door-abutting portion to establish its door-abutting position.

The improvements contemplated by the present invention pertain to the means for pivotally supporting the stop member, the inclusion of a shoulder means in addition to the pivot means for preventing forcible longitudinal movement of the stop member toward the tail portion, and a particular arrangement whereby such a latch assembly abuts a projection attached to an outer door which rides in a track which is exposed to the exterior when the door is in its closed position. The invention also deals with spacer means which prevents unauthorized vertical movement of the door.

Unlike previous devices, the pivot means is connected to the track on both sides of the stop member. A stationary shoulder is positioned adjacent to the tail portion of the stop member when the tail portion is in its uppermost position, thereby resisting forcible movement of the stop member in a direction toward the tail portion. Further, in the case of an outer door which moves in a track exposed to the outside when the door is in its closed position, a projection is affixed to the inside of the door for coaction with the stop member which is movable from an upper position removed from the path of the projection to a lower position located in the path of the projection.

It is well known that sliding closures may be removed by lifting them vertically to move them into the upper track and permit their disengagement from a lower track or guideway, thus enabling an unauthorized entrant to remove the entire closure and gain ingress through the doorway. Unauthorized entries of this type are prevented by providing spacer means in the upper track. Such spacer means may be both a portion of the latch assembly itself and separate spacer blocks attached to the track. The blocks are constructed so that their horizontal and vertical dimensions are unequal when measured in a plane perpendicular to the tracks, and spacer plates are attached thereto in order to provide a wide variety of thicknesses in the block-and-spacer assembly to position it proximate to the upper surface of the door.

For a more complete understanding of the invention in its preferred form, reference is made to the accompanying drawings and the following description of the preferred embodiments.

BRIEF DESCRIPTION OF THE DRAWINGS

FIG. 1 shows a complete door assembly having inner and outer doors, two latch assemblies and a supplemental spacer block.

FIG. 2 shows a latch assembly constructed according to the invention.

FIG. 3 shows the invention wherein the latch assembly is used to lock the outer sliding glass door.

FIG. 4 is a sectional view which shown the relationship between the spacer assembly and a sliding door.

BRIEF DESCRIPTION OF A PREFERRED EMBODIMENT

Sliding glass doors are known to provide an easy access to burglars and other unauthorized entrants. The doors may be forced horizontally in their tracks by a pry bar which easily overcomes the relatively small retaining force afforded by latch assemblies currently in use. Even when it is impossible to slide the doors, as when the homeowner has obstructed the lower door track, unauthorized entry is possible by lifting the doors vertically and swinging the lower edge thereof out of the lower guide rail or track. The door may be completely removed from the door opening for access into the space.

FIG. 1 shows a sliding glass door assembly viewed from the interior of the space which is to be secured. A pair of doors 2 and 4 are supported in a lower track (not shown) of conventional construction and an upper track 6, one flange of which is broken away for illustrative purposes. The tracks guide both doors 2 and 4 for movement in a horizontal linear path between closed positions and open positions. Door 2 will be referred to as the inner door since it lies in a plane closer to the interior of the room than the outer door 4.

This invention is concerned with various means which prevent unauthorized sliding and/or vertical movement of the doors. The basic principles involved are seen in FIG. 2 which shows latch assemblies 8 and 8' mounted in the upper track for the inner door 2. The inner door 2 cannot be moved vertically a significant amount due to the presence of the left end of the latch assembly 8 and the spacer assembly 12 located in the track above the left side of the door 2. Although not shown, the track immediately above the outside door 4 is also provided with a spacer assembly similar to assembly 12 to prevent its upward movement.

The latch assembly 8 has a horizontally elongated stop member provided with a door-abutting portion 14 which is positioned in the path of the door 2 so as to prevent sliding movement of the door to the right. The door abutting portion 14 is pivoted to permit its vertical movement from the illustrated position to an upper position where it lies out of the path of the door, thus permitting free sliding movement of the door.

The latch assembly 8' for the outer door is mounted in the track for the inner door 2. It has a projection-abutting portion 14' which is identical in structure to the door-abutting portion 14 and is likewise vertically movable from the illustrated projection-abutting position to an upper retracted position.

Inasmuch as the projection-butting portion 14' is located on the interior side of the outer door 4, it cannot bear directly on the door itself. Its coaction with the door is achieved by means of a projection which preferably is a block 18 attached to the door 4 at a location where it will traverse a path which may be abutted by the projection-abutting portion 14' of the latch assembly. When the projection-abutting portion 14' is in the illustrated position, it prevents movement of the projection 18 and the attached door 4 to the left or open position.

The details of construction of the latch assemblies 8 and 8' are shown in FIG. 2. The principal two components of the assembly are the base member 20 and a pivoted stop member 22 which includes the door-abutting portion 14 and 14' discussed in connection with FIG. 1. Members 18, 20 and 22 are preferably formed of LEXAN polycarbonate resin.

The base member 20 is a channel which has a transverse cross section in the shape of an inverted U with vertical flanges 24 and 26. Extending transversely between the flanges is an end wall 28 and a rib 30. The end wall 28 and rib 30 strengthen the base member but, more importantly, they provide a structure which extends transversely across the downwardly-open channel to assist the channel in its function as a spacer block which prevents unauthorized upward movement of one end of the door. This may be understood by referring to FIG. 1 which shows the end of the latch assembly 8 positioned above the end of the inner door 2, and the end of latch assembly 8' positioned above the projection 18 on the outer door 4.

The stop member 22 is pivotally connected at 32 for vertical swinging movement in the direction of the arrow 34. A pivot pin, headed at both ends, extends through a transverse bore in the stop member 22 and through both flanges 24 and 26.

The stop member 22 has a tail portion 36 located at its end opposite the door-abutting portion 14. The tail portion 36 serves the dual function of providing a means for moving the door-abutting portion 14 to its door-abutting position and of strengthening the assembly against forcible movement of the stop member 22 to the right, when viewed as shown in FIG. 2. Obviously, pressing upwardly on the tail portion 36 causes movement of the stop member 22 about the pivot means 32 so that the door-abutting portion 14 moves downwardly to the position illustrated in FIG. 2. At the same time, it will be noted that a shoulder 38 on the stop member 22 moves upwardly to confront a stationary shoulder means 40 on the base member 20. Unauthorized forcible movement of the stop member to the right is resisted both by the pivot means 32 and by the abutting relationship between the shoulders 38 and 40.

In order to prevent the door-abutting portion 14 from falling downwardly, small projections or bumps 35 are provided symmetrically on the opposite sides of the stop member 22. Projection-receiving recesses are provided on the vertical flanges 24 and 26 of the base member 20 by holes 37. The projections 35 have their outermost surfaces spaced apart by a distance slightly greater than the distance between the flanges 24 and 26. As the door-abutting portion 14 of the stop member 22 moves upwardly, the projections 35 act on the sidewalls 24 and 26 to flex them outwardly until the projections arrive at the holes 37 where they snap into place to hold the stop member 22 in its retracted position until a force is applied upwardly on the tail member 36.

The latch assembly of FIG. 2 is also useful in preventing movement of an outer door such as the door 4 illustrated in FIG. 1. When this is done, however, it is necessary to provide for a supplemental projection means which is attached to the door, so that the stop member 22 serves as a projection-abutting means rather than acting directly on the door frame. A suitable arrangement of this type is illustrated in FIG. 3 which shows such a projection at 18. The projection has a base portion 44 attached by screws 46 to the frame of the outside door 4. An offset upper portion 48 of the projection 18 extends upwardly beyond the lower edge of flange 50 of the upper track, so that the flange 50 is positioned between the offset upper portion 48 of the projection and the upper portion of the door 4.

Positioned within the inner track of the upper track extrusion is the same latch assembly 8 described above in connection with FIG. 2. As illustrated in FIG. 3, the projection-abutting portion 14 of the stop member 22 is in its upper retracted position, out of the path of the projection 18. Upward pressure on the tail portion 36 of the stop member 22 moves the door-abutting portion 14 to the position illustrated in broken lines in FIG. 3 where it lies in the path of the projection 42 and prevents the door from opening. The projection-abutting portion 14 is restored to its upper retracted position simply by pressing upwardly on the lower surface of the door-abutting portion 14.

FIG. 4 shows a transverse sectional view through the spacer block assembly 12 illustrated in FIG. 1. The spacer assembly includes a block 52 which is rectangular in transverse cross section so that its vertical and horizontal dimensions measured in a plane perpendicular to the door track are unequal. The spacer plate 54 is attached to the lower horizontal face of the spacer block so that the entire spacer assembly is proximate to the upper surface 56 of the door 2.

The spacer block 52 and spacer plate 54 shown in FIG. 4 are particularly useful since they may be placed at various orientations to provide a variety of effective thicknesses, assuring that the spacer assembly will lie proximate to the upper surface of the door. For example, one of the smaller faces of the block 52 may lie against the track, either alone or in conjuction with a spacer plate 54, to provide the desired proximity between the spacer assembly and the upper portion of the door. In some instances, the spacer plates 54 may be omitted, and in other instances, two such plates may be required. At all times however, the purchaser of the elements of the spacer assembly is given the components for performing the desired function in a wide variety of door assemblies.

The latch assemblies 8 may be affixed to the upper track assembly by various means. Double-faced adhesive tape is suitable in some instances, but this is preferably supplemented by screws driven through the horizontal base of the member 20. In installations where there is a substantial distance between the uppermost part of the door and the portion of the track thereabove, spacer assemblies may be positioned between the base member 20 and the track. To facilitate accurate positioning of the latch assembly in the track, the channel 20 may be provided with an index mark 21 which is to be vertically aligned with the edge of the door when in its closed position. Alphanumeric reference characters may be molded into the various parts and keyed to corresponding characters in the installation instructions.

This description has dealt with a preferred embodiment of the invention. It is anticipated that normal evolution of this invention will result in modifications and improvements thereto. Therefore, it is emphasized that the invention is not limited only to the preferred embodiment described herein, but encompasses modifications, variations and improvements thereto which fall within the scope of the following claims. For ease of understanding, certain elements of the invention are described in the nomenclature of a sliding door assembly; however, it is to be understood that the claimed structure is not so limited but may also be used for other types of sliding closures.

I claim:

1. In a sliding closure assembly including an upper track and a sliding closure having an upper portion slidably movable in said upper track, a device for preventing unauthorized movement of said closure from a closed position to an open position, said device comprising, a stop member located within the track, said stop member being elongated in a direction parallel to the track, pivot means supporting said stop member for pivotal movement about a horizontal axis, means on opposite sides of said stop member connecting said pivot means to the track, a closure-abutting portion on said stop member located between the closure and said pivot means, said closure-abutting portion being movable vertically by said pivotal movement between an upper retracted position removed from the path of the closure to a lower closure-abutting position located in the path of the closure to prevent movement thereby of the closure, a tail portion on said stop member, said pivot means being located between the tail portion and the closure, means for limiting to an uppermost position the upward movement of said tail portion thereby limiting the downward movement of the closure-abutting portion to establish its closure-abutting position.

2. The invention of claim 1 having a stationary shoulder means positioned adjacent to said tail portion when in its uppermost position to prevent forcible movement of the stop member in a direction toward said tail portion.

3. The invention of claim 1 having an inverted channel member supporting said stop means in the track, at least one transverse wall extending across said channel member, said closure-abutting portion lying between the transverse wall and said pivot means.

4. The invention of claim 1 having an inverted channel member supporting said stop means in the track, said channel means having flanges located on opposite sides of said stop member, and means on said channel means for engaging said stop member and retaining said closure-abutting portion in its upper retracted position.

5. The invention of claim 4 having a stationary shoulder means positioned adjacent to said tail portion when in its uppermost position to prevent forcible movement of the stop member in a direction toward said tail portion.

6. In a sliding closure assembly including an upper track and a sliding closure having an upper portion slidably movable in said upper track, a device for preventing unauthorized movement of said closure from a closed position to an open position, said track being exposed to the exterior side when the closure is in its closed position, said device comprising, a projection affixed to the interior side of the closure, a stop member located on the interior side of the closure, said stop member being elongated in a direction parallel to the track, pivot means supporting said stop member for pivotal movement about a stationary horizontal axis, a projection-abutting portion on said stop member located between the projection and said pivot means, said projection-abutting portion being movable vertically by said pivotal movement between an upper retracted position removed from the path of the projection to a lower projection-abutting position located in the path of the same projection to prevent movement thereby of the projection and the closure affixed thereto.

7. The invention of claim 6 having a stationary shoulder means positioned adjacent to said tail portion when in its uppermost position to prevent forcible movement of the stop member in a direction toward said tail portion.

8. The invention of claim 6 having an inverted channel member supporting said stop means in the track, at least one transverse wall extending across said channel member, said projection-abutting portion lying between the transverse wall and said pivot means.

9. The invention of claim 6 having an inverted channel member supporting said stop means in the track, said channel means having flanges located on opposite sides of said stop member, and means on said channel means for engaging said stop member and retaining said projection-abutting portion in its upper retracted position.

10. The invention of claim 6 having a stationary member which pivotally supports said stop member and has a portion positioned above said projection to limit the extent of vertical movement of said projection.

11. In a sliding closure assembly including an upper track and a sliding closure having an upper portion slidably movable in said upper track, a device for preventing unauthorized movement of said closure from a closed position to an open position, said device comprising, a stop member located within the upper track, said stop member being elongated in a direction parallel to the track, pivot means supporting said stop member for pivotal movement about a horizontal axis, a closure-abutting portion on said stop member located between the closure and said pivot means, said closure-abutting portion being movable vertically by said pivotal movement between an upper retracted position removed from the path of the closure to a lower closure-abutting position located in the path of the closure to prevent movement thereby of the closure, a tail portion on said stop member, said pivot means being located between the tail portion and the closure, means for limiting to an uppermost position the upward movement of said tail portion thereby limiting the downward movement of the closure-abutting portion to establish its closure-abutting position, and a stationary shoulder means positioned adjacent to said tail portion when in its uppermost position to prevent movement of the stop member in a direction toward said tail portion.

12. The invention of claim 10 having an inverted channel member supporting said stop means in the track, at least one transverse wall extending across said channel member, said closure-abutting portion lying between the transverse wall and said pivot means.

13. The invention of claim 10 having an inverted channel member supporting said stop means in the track, said channel means having flanges located on opposite sides of said stop member, and means on said channel means for engaging said stop member and retaining said closure-abutting portion in its upper retracted position.

14. A device for preventing unauthorized movement of a door or other building closure which is movable in a horizontal linear path within a track from a closed position to an open position, said device comprising, a horizontally elongated stop member, support means including pivot means supporting said stop member for manual pivotal movement about a transverse horizontal axis, said stop member having a closure-abutting portion spaced in a first direction from said pivot means, said closure-abutting portion being movable vertically by said manual pivotal movement between an upper retracted position and a lower closure-abutting position, means for holding said stop member in its upper retracted position when it is moved thereto manually, a tail portion on said stop member spaced from said pivot means in a second direction which is opposite to said first direction, means for limiting to an uppermost position the upward movement of said tail portion thereby limiting the downward movement of the closure-abutting portion to establish its closure-abutting position, and a stationary shoulder means positioned adjacent to said tail portion when in its uppermost position to prevent movement of said stop member in a direction toward said tail portion.

* * * * *